US006486902B1

(12) United States Patent
Spano

(10) Patent No.: US 6,486,902 B1
(45) Date of Patent: Nov. 26, 2002

(54) TWO-COLOR THERMAL PRINTING PROCESS

(75) Inventor: Steven Spano, Ithaca, NY (US)

(73) Assignee: Axiohm Transaction Solutions, Inc., Ithaca, NY (US)

( * ) Notice: Subject to any disclaimer, the term of this patent is extended or adjusted under 35 U.S.C. 154(b) by 0 days.

(21) Appl. No.: 09/747,224

(22) Filed: Dec. 26, 2000

(51) Int. Cl.[7] ..... B41J 35/16
(52) U.S. Cl. ..... 347/172
(58) Field of Search ..... 347/172, 175, 347/110, 133, 189; 358/518, 522, 523, 535, 538, 515, 516

(56) References Cited

U.S. PATENT DOCUMENTS 5,206,719 A * 4/1993 Ikeda et al. ..... 358/518
6,304,278 B1 * 10/2000 Coleman ..... 347/110

* cited by examiner

*Primary Examiner*—John S. Hilten
*Assistant Examiner*—K. Feggins
(74) *Attorney, Agent, or Firm*—George R. McGuire; Hancock & Estabrook, LLP

(57) ABSTRACT

A method for improving the image quality of a thermal print image uses preprocessed image and color matrices, in which special combinations of black dots and black dot patterns are filtered out. These patterns are then replaced with printer-friendly patterns. This altering technique improves the image quality and reduces halo effects.

6 Claims, 2 Drawing Sheets

$$\text{Image} := \begin{bmatrix} C11 & C12 & C13 & Cxx & CM \\ C21 & C22 & C23 & C2x & C2M \\ C31 & C32 & C33 & C3x & C3M \\ Ci1 & Ci2 & Ci3 & Cij & CiM \\ CN1 & CN2 & CN3 & CNj & CNM \end{bmatrix}$$

$$\text{Color Map} := \begin{bmatrix} C11 & C12 & C13 & Cxx & CM \\ C21 & C22 & C23 & C2x & C2M \\ C31 & C32 & C33 & C3x & C3M \\ Ci1 & Ci2 & Ci3 & Cij & CiM \\ CN1 & CN2 & CN3 & CNj & CNM \end{bmatrix}$$

TWO-COLOR THERMAL PRINTING PROCESS

FIELD OF THE INVENTION

The present invention relates to thermal printing techniques and, more particularly, to a method for improving the crispness of the thermal printing image, with the reduction and elimination of halo effects.

BACKGROUND OF THE INVENTION

Two-color, direct, thermal printing is a process in which combinations of colors, such as red and black, are imaged onto a coated paper. In the area of two-color printing, most of the printing is text based. The printing is controlled by an algorithm. The algorithm must be carefully coordinated with the design of the print head and the type of paper being used, in order to achieve an optimal image.

The method of this invention seeks to improve the image quality of graphics and other high resolution data.

The method of the invention uses a thermal printing paper type that is designed for red and black. Red dye in the paper has an image temperature that is distinct from the image temperature for black dye in the paper. Increasing the applied energy to the print head therefore causes a transition from red to black. Moreover, careful control of the dot-to-dot energy on the thermal print head provides distinct red and black color shades.

In two-color printing systems, there is a phenomenon commonly known as the "halo effect". The halo effect is a bleeding of the lower energy color (red), after the higher energy color (black) has been printed. At the termination of the higher energy level, the black dots being printed develop a surrounding shade of red as the printing temperature decays. This decay, or "thermal fall", creates the red border or halo about the black image. The magnitude of the halo is proportional to the thermal fall time.

The halo effect is known to be less perceivable when higher concentrations of black are used. However, the halo is not related to the amount of black being imaged. It is related only to the thermal fall time of the print head. The thermal fall time is constant, and is a function of the print head design. The result is that large black squares appear black, while smaller black squares appear maroon, or a combination of red and black.

Typically, real-time control (i.e., dot-history) can be achieved only in limited sections during printing. This is sufficient for text, but complex graphics, such as logos, coupons, etc., require additional preprocessing.

It is possible to preprocess an image in order to filter out special combinations of black dots and black dot patterns. These patterns can be replaced with printer-friendly patterns without significantly altering the shape of the image form. This pre-filtering method, which is essentially an off-line dot-history control, greatly reduces the associated halo effects. Pre-filtering of an image can be achieved using a printer or a host personal computer. The use of pre-filtering:

a) reduces the demand upon the printer or firmware, b) can be applied to more combinations for which real-time dot-history can compensate, and c) can be applied to the entire image.

The result can be previewed before printing, when applied upon a host personal computer.

A series of special algorithms has been developed, in accordance with this invention, for computing and adjusting an image to provide the best clarity under a certain set of constraints. These constraints are based upon the dot-history control and the thermal properties of the print head.

SUMMARY OF THE INVENTION

In accordance with the present invention, there is provided a method for improving a thermal print image. A series of special algorithms has been developed for computing and adjusting the thermal print image to provide the best clarity under a certain set of constraints. These constraints are based upon the dot-history control and the thermal properties of the print head. An image is preprocessed using image and color matrices, in order to filter out special combinations of black dots and black dot patterns. These patterns are then replaced with printer-friendly patterns. This altering technique improves the image quality, does not significantly alter the shape of the image form, and greatly reduces associated halo effects. Cell areas having a cell size of 4×1 or less are the maximum processing area that can be achieved without deviating from the original image. A 4×2 cell can be processed by horizontally copying a 4×1 cell into its adjacent neighbor.

It is an object of this invention to provide a method for improving a thermal print image.

It is another object of the invention to provide a method for improving a thermal print image quality by filtering out certain black dots and black dot patterns of the thermal print image, and thereafter replacing these patterns with printer-friendly patterns.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features a method of improving the image quality of a thermal print image. The image is preprocessed using image and color matrices, in which special combinations of black dots and black dot patterns are filtered out. These patterns are then replaced with printer-friendly patterns. This altering technique improves the image quality.

Figure 1:
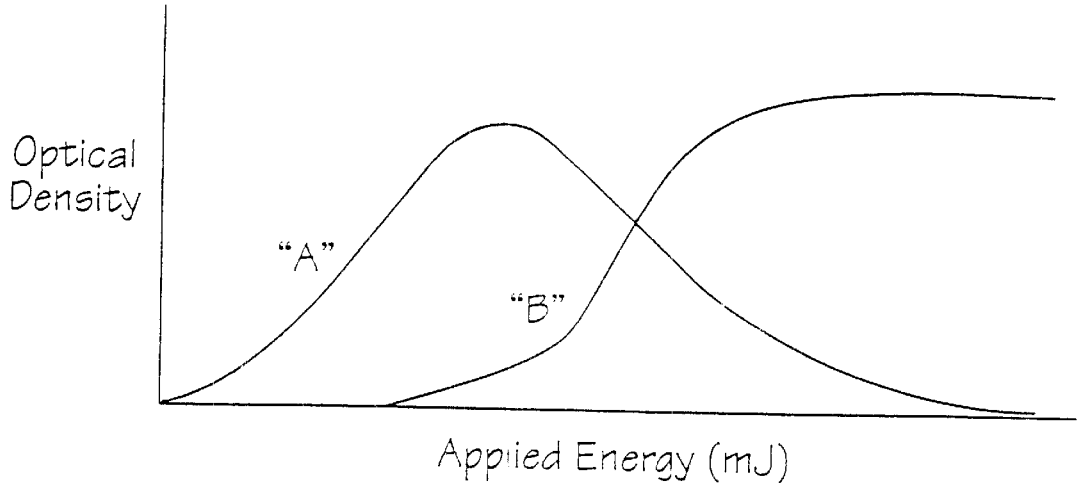
FIG. 1 illustrates a graph of the applied energy versus the optical density in two-color, thermal printing.

Now referring to FIG. 1, a graph of the optical density versus the applied energy in two-color, thermal printing, is illustrated. Two-color direct thermal printing uses special paper that contains two different dyes, such as black and red. The red dye, for example, is designed to image at a temperature "A", and the black dye is designed to image at a temperature "B". The graph shows the dynamic sensitivity for a theoretical paper grade. The curve depicts the transition from red to black, as applied energy is increased. Careful control of the dot-to-dot energy on the thermal print head yields distinct red and black color shades.

Figure 2:
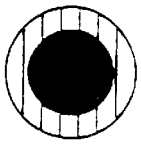
FIG. 2 depicts a representative, greatly enlarged, front view of a black dot with a red halo effect.

An important design tradeoff in the two-color cycle is the creation of a halo effect. The halo effect is a bleeding of the lower energy color (red), after the higher energy color (black) has been printed. The dot temperature of the thermal print head must be raised to temperature "B" in order to achieve the black, but when the print cycle is over, the temperature decays and eventually reaches temperature "A". This decay or thermal fall time creates a red halo around a black dot, as shown in FIG. 2. The magnitude of the halo is proportional to the thermal fall time. The halo effect is known to be less perceivable when higher concentrations of black are used. However, the halo is not related to the amount of black being imaged. It is related only to the thermal fall time of the print head. The thermal fall time is constant, and is a function of the print head design. The result is that large black dots or other shapes appear black, while smaller black shapes appear maroon, or a combination of red and black.

Typically, real-time control (i.e., dot-history) can be achieved only in limited sections during printing. This is sufficient for text, but complex graphics, such as logos, coupons, etc., require additional preprocessing.

It is possible to preprocess an image in order to filter out special combinations of black dots and black dot patterns. These patterns can be replaced with printer-friendly patterns. This technique does not significantly alter the shape of the image form. This method greatly reduces the associated halo effects. Pre-filtering of an image can be achieved using a printer, or a host personal computer. Pre-filtering has the effect of:

a) reducing the demand upon the printer or firmware, b) application to more combinations for which real-time dot-history can compensate, and c) application to the entire image.

The result can be previewed before printing, when applied upon a host personal computer. Pre-filtering is essentially an off-line dot history control.

A series of special algorithms has been developed, in accordance with this invention, for computing and adjusting an image to provide the best clarity under a certain set of constraints. These constraints are based upon the dot-history control and the thermal properties of the print head.

Figures 3, 4:
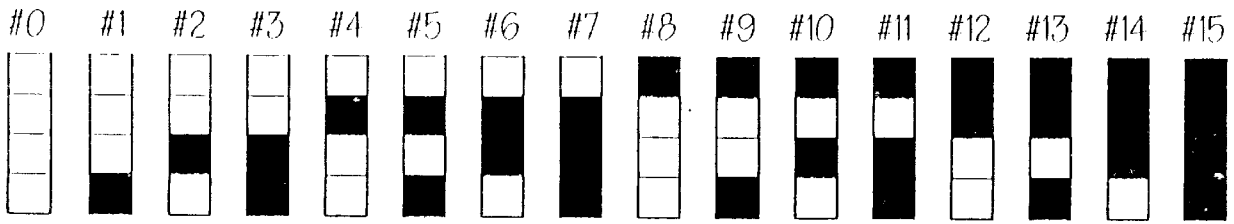
FIG. 3 shows two M×N matrices used to express a two-color image in thermal printing.
FIG. 4 illustrates a schematic view of sixteen possible black dot patterns that can be found in the source image when using a 4×1 cell.

A two-color image can be expressed as two M×N matrices, as shown by FIG. 3. A number of algorithms for processing the thermal print image can process only a cell size having a maximum processing area of 4×1. A 4×2 cell size can be achieved, however, by copying a 4×1 cell into its adjacent neighbor.

In the two-color matrices of FIG. 3, a color table represents a color range from black to white, and colors in between, for each point in an Image Matrix. A reference from the Image Matrix (e.g. [I,J]) is used to select a corresponding color from the Color Matrix. Processing of both the Image and Color Matrices is used to find the black dots and associated black dot patterns that surround the black dots. These patterns are then altered to improve the image clarity.

The basic cell is a 4×1 window, whose vector is illustrated below:

$$WindowVector := \begin{bmatrix} A_{x,y} \\ B_{x,y+1} \\ C_{x,y+2} \\ D_{x,y+3} \end{bmatrix}$$

The coefficients A, B, C, and D represent 16 possible black dot patterns found in the source image, when using a 4×1 cell, as shown in FIG. 4.

The combinations can be classified into binary patterns. Experimental image analysis has yielded a mapping relationship between the source patterns and compensating patterns.

The relationship for the source pattern can be defined by the following expression:

$$SourcePattern := \sum_{n=1}^{4} 2^{(n-1)} ImageMatrix(n + \text{y_offset}, x)$$

The binary result corresponds to a number between 0 and 15, and can be used to process any image with a 4×1 window. The destination vector defines the mapping between the source pattern and the resultant image. The value of the Source Pattern is used as an index into Destination (Source Pattern).

Destination(Source)=[P1 P2 P3 P4 P5 P6 P7 P8 P9 P10 P11 P12 P13 P14 P15 P16]

The value of Destination becomes a new number (0–15). This allows the source pattern from the original image to "select" a replacement pattern. The destination vector result can then be converted into binary form. The resultant binary pattern is inserted in the original image. The relationship between the Image Matrix and the filtered matrix is:

$$FilteredImage(n + \text{y_offset}, x) := Destination\left(\sum_{n=1}^{4} 2^{(n-1)} ImageMatrix(n + \text{y_offset}, x)\right)$$

Variables y_offset and x are used to navigate throughout the image and perform the filtering operation. The above equation allows a mapping definition between the original image (Image Matrix) and the processed image contained in the new matrix (Filtered Image).

This vector replaces pattern #5 with pattern #3, and pattern #10 with pattern #12. This vector operates on the sections of the image with the worst halo. These sections are one-on-one off black dots.

Typically, the white spaces fill in the red. This creates a continuous color tone that is not present in the original image. However, the patterns can be switched to two-on-two off black dots. This achieves nearly the same image, but with greatly reduced halo effects.

Mapping(Source)=[0 1 2 3 4 3 6 7 8 9 12 11 12 13 14 15]

The next example achieves higher contrast between borders of black regions.

Mapping(Source)=[0 1 2 3 4 3 6 3 8 9 12 11 12 13 12 15]

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A method of improving an image in two color thermal printing, comprising the steps of:

(a) filtering from said two color image, in maximum cell areas of 4×2 certain ones of dot patterns, wherein said 4×2 cell areas are formed by horizontally copying a 4×1 cell into an adjacent neighbor; and then (b) replacing said filtered dot patterns of step (a) with printer-friendly patterns, in said two color image.

2. The method for improving an image in two-color thermal printing in accordance with claim 1, wherein said filtering step (a) processes maximum cell areas of 4×1.

3. The method for improving an image in two-color thermal printing in accordance with claim 1, wherein said step (a) uses image and color matrices, in order to filter special combinations of black dots and black dot patterns.

4. A method for reducing halo effects in an image created in two-color thermal printing, comprising the steps of:

a) filtering from a two-color image, in maximum cell areas of 4×2, certain ones of dot patterns, wherein said 4×2 cell areas are formed by horizontally copying a 4×1 cell into an adjacent neighbor; and then b) replacing said filtered dot patterns of step (a) with printer-friendly patterns, in said two-color image.

5. The method for reducing halo effects in an image created in two-color thermal printing in accordance with claim 4, wherein said filtering step (a) processes maximum cell areas of 4×1.

6. The method for reducing halo effects in an image created in two-color thermal printing in accordance with claim 4, wherein said step (a) uses image and color matrices, in order to filter special combinations of black dots and black dot patterns.

* * * * *